US006715421B2

(12) United States Patent
Lewis

(10) Patent No.: US 6,715,421 B2
(45) Date of Patent: Apr. 6, 2004

(54) TRANSFER IMAGING WITH METAL-BASED RECEIVERS

(75) Inventor: Thomas E. Lewis, East Hampstead, NH (US)

(73) Assignee: Presstek, Inc., Hudson, NH (US)

( * ) Notice: Subject to any disclaimer, the term of this patent is extended or adjusted under 35 U.S.C. 154(b) by 75 days.

(21) Appl. No.: 10/087,280

(22) Filed: Mar. 1, 2002

(65) Prior Publication Data

US 2002/0121207 A1 Sep. 5, 2002

Related U.S. Application Data

(60) Provisional application No. 60/272,589, filed on Mar. 1, 2001.

(51) Int. Cl.[7] ..... B41C 1/055; B41C 1/10

(52) U.S. Cl. ..... 101/467; 101/457

(58) Field of Search ..... 101/454, 457, 101/458, 459, 463.1, 465, 466, 467

(56) References Cited

U.S. PATENT DOCUMENTS 3,971,660 A * 7/1976 Staehle ..... 430/18
5,165,343 A * 11/1992 Inoue et al. ..... 101/395
5,328,804 A * 7/1994 Podszun et al. ..... 430/283.1
5,339,737 A 8/1994 Lewis et al. ..... 101/454
5,402,725 A * 4/1995 Vermeersch et al. ..... 101/453
5,460,918 A * 10/1995 Ali et al. ..... 430/200
5,563,019 A * 10/1996 Blanchet-Fincher ..... 430/200
5,570,636 A 11/1996 Lewis ..... 101/454
5,819,661 A * 10/1998 Lewis et al. ..... 101/467
6,014,930 A * 1/2000 Burberry et al. ..... 101/456
6,105,500 A * 8/2000 Bhambra et al. ..... 101/455
6,182,569 B1 2/2001 Rorke et al. ..... 101/457
6,182,570 B1 2/2001 Rorke et al. ..... 101/462
6,186,067 B1 2/2001 Rorke et al. ..... 101/467
6,192,798 B1 2/2001 Rorke et al. ..... 101/457
6,207,349 B1 3/2001 Lewis ..... 430/302
6,251,334 B1 6/2001 Lewis ..... 264/517
6,293,197 B1 * 9/2001 Ray et al. ..... 101/455
6,295,927 B1 * 10/2001 Verschueren ..... 101/462
6,357,351 B1 * 3/2002 Bhambra et al. ..... 101/455
6,374,738 B1 4/2002 Lewis et al. ..... 101/467
6,378,432 B1 4/2002 Lewis ..... 101/467
6,399,276 B1 * 6/2002 Van Damme et al. ... 430/273.1

* cited by examiner

*Primary Examiner*—Stephen R. Funk
(74) *Attorney, Agent, or Firm*—Testa, Hurwitz & Thibeault, LLP

(57) ABSTRACT

Metal-based printing members suitable for transfer-type imaging include a metal substrate and a hydrophilic, polymeric coating thereover. Desirably, the polymeric coating is crosslinked and withstands repeated application of fountain solution during printing. The polymeric coating can, however, undergo degradation where exposed to fountain solution so long as the ink-receptive portions—the areas where oleophilic material has been transferred onto the hydrophilic coating—remain intact.

16 Claims, 2 Drawing Sheets

TRANSFER IMAGING WITH METAL-BASED RECEIVERS

RELATED APPLICATION

This application claims priority to and the benefits of U.S. Provisional Application Ser. No. 60/272,589, filed on Mar. 1, 2001.

FIELD OF THE INVENTION

The present invention relates to imaging with laser devices, and in particular to transfer-type imaging of lithographic printing plates.

BACKGROUND OF THE INVENTION

In offset lithography, an image to be transferred to a recording medium is represented on a plate, mat or other printing member as a pattern of ink-accepting (oleophilic) and ink-repellent (oleophobic) surface areas. In a dry printing system, the member is simply inked and the image transferred onto a recording material; the member first makes contact with a compliant intermediate surface called a blanket cylinder which, in turn, applies the image to the paper or other recording medium. In typical sheet-fed press systems, the recording medium is pinned to an impression cylinder, which brings it into contact with the blanket cylinder.

In a wet lithographic system, the non-image areas are hydrophilic in the sense of affinity for dampening (or "fountain") solution, and the necessary ink-repellency is provided by an initial application of such a solution to the plate prior to inking. The fountain solution prevents ink from adhering to the non-image areas, but does not affect the oleophilic character of the image areas.

If a press is to print in more than one color, a separate printing plate corresponding to each color is required. The plates are each mounted to a separate plate cylinder of the press, and the positions of the cylinders coordinated so that the color components printed by the different cylinders will be in register on the printed copies. Each set of cylinders associated with a particular color on a press is usually referred to as a printing station.

Because of the ready availability of laser equipment and their amenability to digital control, significant effort has been devoted to the development of laser-based imaging systems. Early examples utilized lasers to etch away material from a plate blank to form an intaglio or letterpress pattern. See, e.g., U.S. Pat. Nos. 3,506,779 and 4,347,785. This approach was later extended to production of lithographic plates, for example, by removal of a hydrophilic surface to reveal an oleophilic underlayer. See, e.g., U.S. Pat. No. 4,054,094. These systems generally require high-power lasers, which are expensive and slow.

A second approach to laser imaging involves the use of thermal-transfer materials. See, e.g., U.S. Pat. Nos. 3,945,318; 3,962,513; 3,964,389; 4,395,946, 5,156,938; 5,171,650; and 5,819,661. With these systems, a polymer sheet transparent to the radiation emitted by the laser is coated with a transferable material. During operation the transfer side of this construction is brought into contact with a receiver sheet, and the transfer material is selectively irradiated through the transparent layer. Irradiation causes the transfer material to adhere preferentially to the receiver. The transfer and receiver materials exhibit different affinities for fountain solution and/or ink, so that removal of the transparent layer together with unirradiated transfer material leaves a suitably imaged, finished printing plate. Typically, the transfer material is oleophilic and the receiver is hydrophilic.

The term "hydrophilic" is herein used in the printing sense to connote a surface affinity for a fluid which prevents ink from adhering thereto. Such fluids include water, aqueous and non-aqueous dampening liquids, and the non-ink phase of single-fluid ink systems. Thus, a hydrophilic surface in accordance herewith exhibits preferential affinity for any of these materials relative to oil-based materials. The term "liquid to which ink will not adhere" connotes not only the traditional dampening solutions as described above, but also extends to polar fluids that may be incorporated within an ink composition itself. For example, so-called "water-borne" inks (or other single-fluid ink systems) contain an aqueous fraction that will remove an inorganic protective layer in accordance herewith as the plate is used for printing.

The most common hydrophilic surface used in lithographic applications is textured metal, e.g., aluminum that has been surface-treated (typically by graining and/or anodization). Although chromium and stabilized aluminum grain surfaces exhibit good durability characteristics during printing, their hydrophilic character also renders them hygroscopic. Excessive sorption of moisture facilitates ongoing chemical reaction that may result in reduction or elimination of hydrophilic character. For this reason, if plates having such surfaces are to be stored, they typically first receive a coating of a protective, water-soluble polymer in a process known as "gumming."

While suitable for many wet-printing applications, in which the protective coating is washed away during the print make-ready process, gummed plates cannot ordinarily be used in transfer applications; the protective coating is designed to be removed and therefore cannot serve as the permanent receiver surface for oleophilic transfer material. Thus, if metal-based plates are to be used as hydrophilic receivers in transfer-type applications, traditional approaches to surface stabilization cannot generally be employed. The plate must be maintained in a highly clean and moisture-free environment to avoid image degradation.

DESCRIPTION OF THE INVENTION

BRIEF SUMMARY OF THE INVENTION

The present invention provides metal-based printing members suitable for transfer-type imaging. In general, these printing members comprise a metal substrate and a hydrophilic, polymeric coating thereover. Desirably, the polymeric coating is crosslinked and withstands repeated application of fountain solution during printing. The polymeric coating can, however, undergo degradation where exposed to fountain solution so long as the ink-receptive portions—the areas where oleophilic material has been transferred onto the hydrophilic coating—remain intact. This is because the coating acts to stabilize the underlying textured metal surface, so that even if the coating is worn completely away, a suitably hydrophilic metal surface will be exposed.

Accordingly, in a first aspect, the invention relates to a transfer-type method of imaging a recording construction. In this aspect, the invention utilizes a donor member comprising a transferable oleophilic material and a receiver member comprising a metal substrate having a hydrophilic, polymeric layer thereover. The donor member is irradiated in a pattern corresponding to an image so as to cause displacement of the oleophilic material onto the hydrophilic, polymeric layer of the receiver member. The result is a lithographic image—i.e., an imagewise pattern of ink-accepting and hydrophilic regions.

In a second aspect, the invention relates to an ink-jet (or similar jetting) method of imaging a recording construction. In this aspect, the invention utilizes a receiver member comprising a metal substrate and a hydrophilic, polymeric layer thereover. An oleophilic material, such as liquid inks based on hydrocarbon solvents, is ejected onto the polymeric layer in an imagewise pattern, thereby creating a lithographic image.

In a third aspect, the invention relates to a hydrophilic-surfaced lithographic printing precursor capable of receiving thereon an oleophilic material in an imagewise pattern. The precursor has a metal substrate whose surface is hydrophilic and, over the surface, a hydrophilic, polymeric layer. The precursor can receive oleophilic material in an imagewise pattern by means of any suitable transfer technique, such as thermal transfer from a sheet or by jetting.

BRIEF DESCRIPTION OF THE DRAWINGS

The foregoing discussion will be understood more readily from the following detailed description of the invention, when taken in conjunction with the accompanying drawings, in which.

DETAILED DESCRIPTION OF THE PREFERRED EMBODIMENTS

Figure 1:
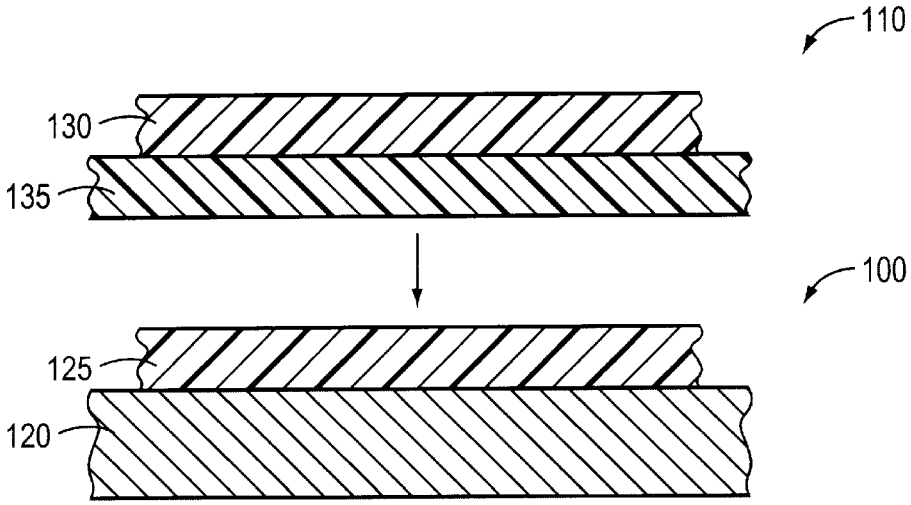
FIG. 1 is an enlarged elevation of donor and receiver members in accordance with the invention.

Refer first to FIG. 1, which illustrates a receiver member 100 and a representative donor member 110 in accordance with the invention. Receiver member 100 includes a hydrophilic metal layer 120 and an overlying polymeric hydrophilic layer 125. Donor member 110 includes a carrier film layer 130 that is transparent to imaging radiation and, bonded thereto, a transfer layer 135 that responds to imaging radiation as described below.

Suitable materials for layer 120 include those known in the art as substrates for lithographic printing plates, and include aluminum, copper, steel, and chromium sheets with hydrophilic surfaces. Rendering a layer of, for example, aluminum—which is hydrophilic but fragile in an unstructured or polished state—sufficiently durable to repeatedly accept fountain solution in a printing environment requires special treatment. Any number of chemical or electrical techniques, in some cases assisted by the use of fine abrasives to further roughen the surface, may be employed for this purpose. For example, electrograining involves immersion of two opposed aluminum plates (or one plate and a suitable counterelectrode) in an electrolytic cell and passing alternating current between them. The result of this process is a finely pitted surface topography that readily adsorbs water. See, e.g., U.S. Pat. No. 4,087,341.

A structured or grained surface can also be produced by controlled oxidation, a process commonly called "anodizing." The anodized aluminum plate consists of an unmodified base layer and a porous, "anodic" aluminum oxide coating thereover; this coating readily accepts water. However, without further treatment, the oxide coating would lose wettability due to further chemical reaction. Anodized plates are, therefore, typically exposed to a silicate solution or other suitable (e.g., phosphate) reagent that stabilizes the hydrophilic character of the plate surface. In the case of silicate treatment, the surface may assume the properties of a molecular sieve with a high affinity for molecules of a definite size and shape—including, most importantly, water molecules. The treated surface also promotes adhesion to an overlying photopolymer layer. Anodizing and silicate treatment processes are described in U.S. Pat. Nos. 3,181,461 and 3,902,976.

Textured chromium surfaces also exhibit substantial hydrophilic character, and can be used in lieu of aluminum in wet-running lithographic plates. Such surfaces can be produced by, for example, electrodeposition, as described in U.S. Pat. No. 4,596,760. As used herein, the term "textured" refers to any modification to the surface topography of a metal plate that results in enhancement of hydrophilic character.

Thus, layer 120 can be a metal support that has been anodized without prior graining, a metal support that has been grained and anodized, or a metal support that has been grained, anodized, and treated with an agent effective to render the metal permanently hydrophilic (for example, silicate). In one embodiment, an aluminum substrate 120 comprises a surface of uniform, non-directional roughness and microscopic uniform depressions, and, preferably, has a peak count in the range of 300 to 450 peaks per linear inch, and which extend above and below a total bandwidth of 20 microinches, as described in published PCT Application No. WO 97/31783. A suitable aluminum substrate having a uniform and non-directional roughness and microscopic uniform depressions is the SATIN FINISH aluminum sheet supplied by Alcoa, Inc., Pittsburgh, Pa.

Preferred thicknesses for metal layer 120 range from 0.003 to 0.02 inch, with thicknesses in the range of 0.006 to 0.012 inch being particularly preferred.

Layer 125 is a hydrophilic polymer, which should adhere well to the hydrophilic surface of underlying layer 120. For example, polymeric materials having exposed polar moieties (such as hydroxyl or carboxyl groups) tend to exhibit good adhesion and may be crosslinked. Suitable polymers include, but are not limited to, polyvinyl alcohol or copolymers thereof. In a preferred embodiment, the polymer is polyvinyl alcohol, such as, for example, the polyvinyl alcohol available under the trademarks AIRVOL 325 from Air Products, Allentown, Pa.; and ESPRIX R-1130 from Esprix Chemical Co. Other suitable polymers include copolymers of polyvinyl alcohol, polyvinyl pyrrolidone (PVP) and copolymers thereof, and polyvinylether (PVE) and its copolymers, including polyvinylether/maleic anhydride versions.

Preferably, the hydrophilic layer 125 withstands repeated application of fountain solution during printing without substantial degradation or solubilization. In particular, degradation of layer 125 may take the form of swelling of the layer and/or loss of adhesion to layer 120. One test of withstanding the repeated application of fountain solution during printing is a wet rub resistance test. Satisfactory results for withstanding the repeated application of fountain solution and not being excessively soluble in water or in a cleaning solution, as defined herein, are the retention of the 3% dots in the wet rub resistance test.

To provide insolubility to water, for example, polymeric reaction products of polyvinyl alcohol and crosslinking agents such as glyoxal, zinc carbonate, and the like are well known in the art. For example, the polymeric reaction products of polyvinyl alcohol and hydrolyzed tetramethylorthosilicate or tetraethylorthosilicate are described in U.S. Pat. No. 3,971,660. Suitable polyvinyl alcohol-based coatings for use in the present invention include, but are not limited to, combinations of the AIRVOL 125 polyvinyl alcohol materials supplied by Air Products, Inc., Allentown, Pa.; the BACOTE 20 ammonium zirconyl carbonate solution available from Magnesium Elektron, Flemington, N.J.; glycerol; and the TRITON X-100 surfactant available from Rohm & Haas, Philadelphia, Pa. In general, the BACOTE 20 is used at concentrations substantially higher than necessary to achieve simple crosslinking. For example, proportions of BACOTE 20 (by weight) in excess of 20%, and more desirably from 25 to 30%, are preferred.

Accordingly, in one embodiment, the hydrophilic layer 125 comprises a hydrophilic polymer and a crosslinking agent. In a preferred embodiment, the hydrophilic polymer of the layer 125 is polyvinyl alcohol. The crosslinking agent may be a zirconium compound, preferably ammonium zirconyl carbonate.

If formulated and processed properly, a zirconium-rich phase forms toward the interface with the aluminum. Without being bound to any particular theory or mechanism, this layer may result from a reaction of the zirconium complex promoted by the anodic layer on an aluminum layer 120, the silicate treatment of this layer, or a combination of both. In addition, proper formulation and processing of the multiphase layer causes "nodules" rich in $ZrO_2$ to be formed and dispersed within the polymer-rich phase. These nodules appear to be important for ultimate performance of the layer 125 in terms of adhesion, durability, and hydrophilicity.

While a zirconium-rich phase is preferred, more generally layer 125 may contain any of a variety of inorganic inorganic oxides, typically formed as a reaction product of an initially soluble complex. Such inorganic oxides may include zirconium oxide (typically $ZrO_2$), as discussed, or aluminum oxide (typically $Al_2O_3$), silicon dioxide, or titanium oxide (typically $TiO_2$), as well as combinations and complexes thereof. It should also be noted that these oxides may exist in hydrated form.

Other components and suitable additives may be included in the formulations for the layer 125 to facilitate coating, curing, or imaging processes. Such components include, but are not limited to, NACURE 2530, a trademark for an amine-blocked organic sulfonic acid catalyst available from King Industries, Norwalk, Conn.; CYMEL 303, a trademark for melamine crosslinking agents available from Cytec Corporation, Wayne, N.J. Suitable additives include, but are not limited to, glycerol, available from Aldrich Chemical, Milwaukee, Wis.; TRITON X-100, noted above; pentaerythritol; glycols such as ethylene glycol, diethylene glycol, trimethylene diglycol, and propylene glycol; citric acid, glycerophosphoric acid; sorbitol; and gluconic acid.

Layer 125 is typically coated to a dry thickness in the range of from about 1 to about 40 $\mu$m and more preferably in the range of from about 2 to about 25 $\mu$m. After coating, the layer is dried and subsequently cured at a temperature between 135° C. and 185° C. for between 10 sec and 3 min, and more preferably at a temperature between 145° C. and 165° C. for between 30 sec and 2 min.

The characteristics of donor member 110 are not critical to the invention; any construction capable of transferring a suitable oleophilic material in an imagewise pattern onto receiver member 100 will be satisfactory. For example, U.S. Pat. Nos. 3,945,318; 3,962,513; 3,964,389; 4,245,003; 4,395,946; 4,588,674; and 4,711,834 (the disclosures of which are hereby incorporated by reference) describe "laser ablation transfer" systems in which a polymer sheet transparent to the radiation emitted by the laser is coated with a transferable material. During operation the transfer side of this construction is brought into contact with a receiver, and the transfer material is selectively irradiated through the transparent layer. Typically, the transfer material exhibits a high degree of absorbence for imaging laser radiation, and ablates—that is, virtually explodes into a cloud of gas and charred debris—in response to a laser pulse. This action, which may be further enhanced by self-oxidation (as in the case, for example, of nitrocellulose materials), ensures complete removal of the transfer material from its carrier. Material that survives ablation adheres to the receiver. U.S. Pat. Nos. 5,156,938 and 5,171,650 (the disclosures of which are hereby incorporated by reference) describe a variation of this approach involving "dynamic release layers" that absorb imaging radiation at a rate sufficient to effect ablation mass transfer by gas or plasma pressure.

U.S. Pat. No. 5,819,661, the disclosure of which is hereby incorporated by reference, describes a thermal-transfer approach that does not involve ablation. In response to an imaging pulse, a transfer material reduces in viscosity to a flowable state. The material exhibits a higher melt adhesion for a plate substrate than for the carrier sheet to which it is initially bound, so that in a flowable state it transfers completely to the substrate. Following transfer, the carrier sheet, along with untransferred material, is removed from the substrate.

Alternatively, instead of laser activation, transfer of the thermal material can be accomplished through direct contact. U.S. Pat. No. 4,846,065, for example, describes the use of a digitally controlled pressing head to transfer oleophilic material to an image carrier.

Any of these approaches can be used to advantage in connection with the present invention.

Figure 2:
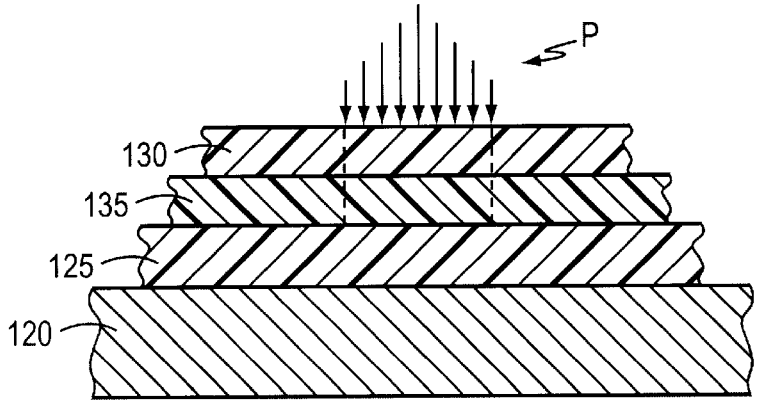
FIG. 2 illustrates the manner in which the donor and receiver members are brought into contact and imaged.
Figure 3:
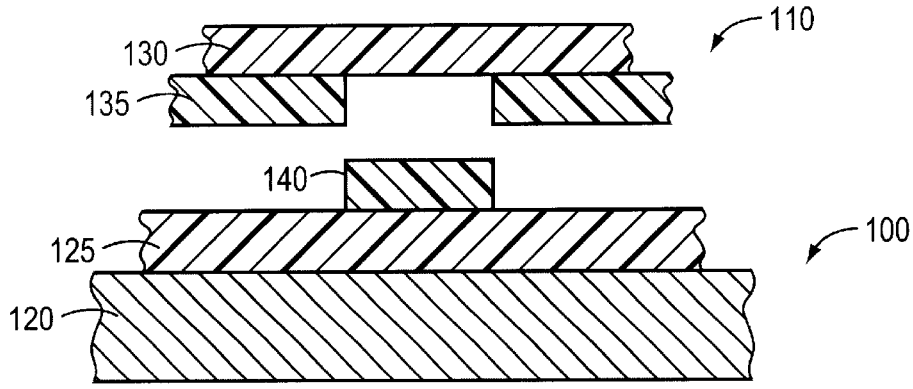
FIG. 3 shows the results of transfer following imaging and separation of the donor and receiver members.

Refer now to FIGS. 2 and 3, which illustrate the manner in which a suitable construction is imaged in accordance with the present invention. As shown in FIG. 2, donor member 110 is brought into intimate contact with receiver member 100. An imaging pulse P from a laser or other suitable source strikes the construction, illuminating an area indicated by the dashed boundaries. Suitable imaging systems are described, for example, in U.S. Pat. Nos. 5,351,617 and 5,385,092 (the disclosures of which are hereby incorporated by reference). These systems use low-power lasers whose discharges are guided from the diode to the printing plate and focused onto its surface (or, desirably, onto the layer most susceptible to laser radiation, which in this case lies beneath the first surface layer).

Layer 135 is formulated to interact in a controlled fashion with imaging radiation, transferring material to layer 125 in the region of exposure. Thus, the construction is irradiated in an imagewise manner, causing transfer of material to layer 125 in accordance with that pattern. When the donor member 110 is removed from receiver member 100, the oleophilic transferred material 140 remains anchored to hydrophilic layer 125, and the difference in affinities result in a finished lithographic plate.

Figure 4:
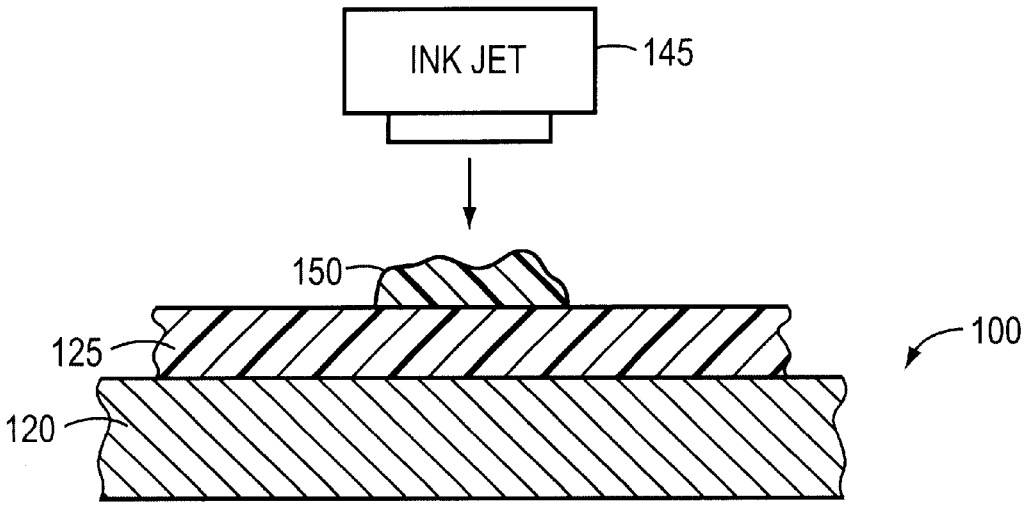
FIG. 4 illustrates imaging of a printing member in accordance with the invention using jetting rather than transfer.

In still another approach, as illustrated in FIG. 4, the invention employs an ink-jet (or similar jetting) apparatus 145 to apply the oleophilic material onto the surface of layer 125 as a jetted droplet 150, which solidifies into an image spot. For example, as described in U.S. Pat. Nos. 6,152,037;

6,120,655; and 4,833,486, the disclosures of which are hereby incorporated by reference, conventional ink-jet printing equipment is used to apply an imagewise pattern of ink onto a receiver surface. The ink, which may be "fixed" following deposition in order to increase its permanence, serves as a pattern of oleophilic sites for lithographic printing. As explained in the previously mentioned patents, the inks commonly employed in ink-jet plate-imaging applications are oleophilic in nature—for example, solid inks based on one or more natural and/or synthetic waxes, and liquid inks based on hydrocarbon solvents.

It will therefore be seen that the foregoing approach provides metal-based recording constructions that may be imaged without the need for measures to protect a delicate hydrophilic metal surface. The terms and expressions employed herein are used as terms of description and not of limitation, and there is no intention, in the use of such terms and expressions, of excluding any equivalents of the features shown and described or portions thereof, but it is recognized that various modifications are possible within the scope of the invention claimed.

What is claimed is:

1. A method of imaging a recording construction, the method comprising the steps of:

a. providing a donor member comprising a transferable oleophilic material;

b. providing a receiver member comprising a metal substrate and a hydrophilic, organic polymeric layer thereover; and c. imagewise irradiating the donor member so as to cause imagewise displacement of the oleophilic material in the region of radiation exposure onto the hydrophilic, organic polymeric layer of the receiver member, thereby creating a lithographic image.

2. The method of claim 1 wherein the metal substrate has a textured, hydrophilic surface.

3. The method of claim 1 wherein the hydrophilic, polymeric layer is crosslinked and withstands repeated application of fountain solution during printing.

4. The method of claim 3 wherein the polymeric layer comprises polyvinyl alcohol.

5. The method of claim 4 wherein the polymeric layer further comprises an inorganic oxide.

6. A hydrophilic-surfaced lithographic printing precursor comprising:

a. a metal substrate having a hydrophilic surface;

b. thereover, a hydrophilic, organic polymeric layer; and c. detachably disposed on the polymeric layer, an oleophilic donor layer comprising a radiation-sensitive material facilitating transfer of the donor in response to imaging radiation.

7. The precursor of claim 6 wherein the metal-substrate surface is textured.

8. The precursor of claim 6 wherein the hydrophilic, polymeric layer is crosslinked and withstands repeated application of fountain solution during printing.

9. The precursor of claim 8 wherein the polymeric layer comprises polyvinyl alcohol.

10. The precursor of claim 9 wherein the polymeric layer further comprises an inorganic oxide.

11. The precursor of claim 10 wherein the inorganic oxide is zirconium oxide.

12. The precursor of claim 10 wherein the inorganic oxide is aluminum oxide.

13. The precursor of claim 10 wherein the inorganic oxide is silicon dioxide.

14. The precursor of claim 10 wherein the inorganic oxide is titanium oxide.

15. The precursor of claim 8 wherein the polymeric layer comprises polyvinyl pyrrolidone.

16. The precursor of claim 8 wherein the polymeric layer comprises polyvinyl ether.

* * * * *